US006481724B1

(12) United States Patent
Whipp

(10) Patent No.: US 6,481,724 B1
(45) Date of Patent: Nov. 19, 2002

(54) ADAPTER FOR CONVERTING IN-LINE ROLLER SKATES TO ICE SKATES

(76) Inventor: Renny Carl Whipp, R.R. 3, Ilderton, Ontario (CA), M0M 2A0

( * ) Notice: Subject to any disclaimer, the term of this patent is extended or adjusted under 35 U.S.C. 154(b) by 0 days.

(21) Appl. No.: 09/828,178

(22) Filed: Apr. 9, 2001

(51) Int. Cl.[7] ..... A63C 17/18

(52) U.S. Cl. ..... 280/7.13; 280/11.18; 280/11.221; 280/11.223

(58) Field of Search ..... 280/7.13, 7.14, 280/11.18, 11.221, 11.223, 11.27

(56) References Cited

U.S. PATENT DOCUMENTS

| | | | | | |
|---|---|---|---|---|---|
| 1,010,105 | A | | 11/1911 | Zipple | |
| 1,266,386 | A | * | 5/1918 | Barr | 280/11.32 |
| 1,527,840 | A | * | 1/1925 | Chomin | 280/11.223 |
| 1,530,211 | A | * | 3/1925 | Siemnash | 16/45 |
| 2,148,687 | A | | 2/1939 | English | 280/7.13 |
| 2,209,116 | A | | 7/1940 | Friedman | 280/11.1 |
| 4,008,901 | A | * | 2/1977 | Conn | 280/11.3 |
| 4,351,536 | A | | 9/1982 | Sandino | 280/7.13 |
| 4,492,385 | A | * | 1/1985 | Olson | 280/11.231 |
| 4,932,675 | A | | 6/1990 | Olson et al. | 280/7.13 |
| 5,193,827 | A | | 3/1993 | Olson | 280/7.13 |
| 5,388,846 | A | | 2/1995 | Gierveld | 280/11.22 |
| 5,411,278 | A | | 5/1995 | Wittman | 280/11.22 |
| 5,531,462 | A | * | 7/1996 | Gu | 280/11.231 |
| 5,595,392 | A | | 1/1997 | Casillas | 280/7.13 |
| 5,727,796 | A | * | 3/1998 | Zhang | 280/11.231 |
| 5,735,536 | A | | 4/1998 | Myers et al. | 280/7.13 |
| 5,906,380 | A | | 5/1999 | Searby et al. | 280/7.13 |
| 5,961,129 | A | | 10/1999 | Post et al. | 280/7.13 |
| 6,039,328 | A | * | 3/2000 | Pawlowski et al. | 280/11.12 |
| 6,068,268 | A | * | 5/2000 | Cornelius et al. | 280/11.19 |

* cited by examiner

*Primary Examiner*—Robert P. Olszewski
*Assistant Examiner*—James S. McClellan
(74) *Attorney, Agent, or Firm*—Anthony Asquith & Co.

(57) ABSTRACT

The adapter comprises an ice-blade mounted in a blade-chassis. The blade-chassis is a plastic molding, which fits between the support rails of an in-line roller skate, and is clamped therebetween by the spindle-rods that serve as the spindles of the rollers. The ice-blade resides in a channel in the blade-chassis, the roof of the channel, and of the blade, being clear of, and below, the spindle rods.

19 Claims, 6 Drawing Sheets

ADAPTER FOR CONVERTING IN-LINE ROLLER SKATES TO ICE SKATES

This invention relates to skate-boots, and to an adapter whereby the same skate-boots may be utilised interchangeably as both ice skates and in-line roller skates.

BACKGROUND TO THE INVENTION

In-line roller skating has recently become very popular; ice-skating, of course, has been popular for many years. The invention lies in an adapter for converting in-line roller skates for ice-skating.

In comparing the different needs of the two different types of skating, it is recognised that the requirements of the skate-boot are more or less the same for both types. Traditionally, upon purchasing both roller skates and ice-skates, the skater now has two pairs of skate-boots. The pairs are more or less the same, except for the structures underneath the boot.

The boot itself is a large part of the cost. As a result, often, a skater who wishes to enjoy both types of skating has to make do, for economic reasons, with equipment of less quality, simply because of the duplication of the expensive boots. The adapter of the invention is aimed at making possible the economies that result from being able to take the rollers off the roller-skate boot, and to attach an ice-skate unit to the boot, in their place.

A good deal of research and development has gone into the design of the boots intended specifically for in-line roller skates—perhaps even more than into the boots designed specifically for ice-skates. Many dual-mode skaters wish they could purchase a pair of ice-skate boots that have the quality and performance of their roller-skate boots. The adapter of the invention is aimed at making it possible for the high-performance boot structure often found in in-line roller-skates to be available for use with ice-skates.

Of course, it would be a simple matter to devise an ice-skate adapter system, if the adapter could be custom-fitted to every brand and size of in-line roller skate. It has been recognised, in one aspect of the invention, that custom-fitting is not necessary, and it has been recognised that a single design of adapter is all that is needed to enable the conversion of almost any brand or size of in-line roller skate into a robust, high-performance, ice-skate.

Although the design of the adapter lends itself to standardisation, if desired non-standard versions may be tailored specifically to a particular brand-style and size of skate.

Often, people like to enjoy ice-skating in winter and in-line roller skating in summer. It is an aim of the invention to provide an adapter that has no loose parts to be lost over a period of a few months. Also, it is an aim to provide an adapter, in which the task of changing from in-line roller-skate to ice-skate, and back again, can be accomplished quickly and easily, and in a manner that is commensurate with the routine maintenance tasks skaters normally have to carry out, and in which, even after the changeover between the rollers and the ice-blade has been made many times, the routine act of making the changeover leaves both modes of the skate tight and secure, and safe.

GENERAL FEATURES OF THE INVENTION

It is recognised, in the invention, that virtually all in-line roller skates use rollers that have substantially the same dimensions. In particular, even when the rollers differ as to quality of materials, or even differ slightly as to overall diameter, still the rollers all have the same overall thickness or width W at the axle. In nearly all of the rollers currently in use, this width W is 0.9 inches. It is also recognised that the diameter D of the spindle upon which the rollers are mounted is also standardised—to ¼ inch diameter. Other standard sizes are sometimes encountered; for example, some brands of youth skate have a width of 0.75 inches, although the spindle remains the same, at ¼ inch.

The standardisation of rollers also means that certain aspects of the boots, in turn, have been correspondingly standardised, at least as regards the dimensions of the mountings for the rollers. (Such aspects of boot performance as lateral support, ankle-hinges, manner of tightening the boot to the foot, etc, however, are within the domain of each manufacturer, and have not been standardised.) The invention is aimed at taking advantage of this standardisation of some of the boot dimensions.

The invention provides a blade-chassis that has the same width as the width W of the standard rollers. That is to say, the blade-chassis is 0.9 inches wide. If some other standard width W came to be adopted for rollers, presumably that same width could be adopted also for the blade-chassis, if it was close to 0.9 inches. However, it is recognised, in the invention, that a width of 0.9 inches is highly suitable for the blade-chassis of an ice-skate, as will be described.

The metal ice-blade is fixed into the blade-chassis, which can be a plastic moulding, and the forces arising from the ice-blade are fed into the boot, through the blade-chassis. It is recognised that, following the standard 0.9 inches dimension, the space envelope available for the chassis is such that the chassis can be highly rigid, and very easily able to support the sometimes heavily abusive forces that can arise between the blade and the boot, which can arise especially when the skater is playing hockey.

For the adapter to find favour, the task of changing the skates from in-line rollers to ice-skates should be undemanding as to skill and attention on the part of the skater. No delicate adjustments should be called for. No special tools should be needed. The task of taking rollers out of the skate-boot is a routine and regular maintenance procedure that can be handled by any roller-skate enthusiast, and, as will become clear, the task of inserting the blade-chassis and the ice-skate blade, together, as a unit, is even simpler.

When the rollers are not in use, they may be kept, e.g in the box with the other spare rollers that most enthusiasts have on hand. The design of the rollers is such that, when the rollers are taken out of the skate, there are no loose pieces that fall off. The rollers have bearings, but these are pressed in, and the bearings generally do not fall out of the rollers. Similarly, when the ice-skate adapter unit is not in use, it is a one-piece unit, with no loose components to fall off. A pair of the ice-skate adapter units can easily be stored, and be instantly made ready for re-use.

The ice-skate adapter unit is held in place with the same spindle rods that are used to hold the rollers in place, so no loose components of the spindle rods arise, in either mode of skating. It may be noted that if the spindle rods were set aside, as the rollers are set aside, during the ice-skating mode, it would be all to easy for the spindle-rods to become lost. The spindle-rods are not subjected to any more stressful treatment in the ice skates than they are subjected to in the rollers mode, for which they were designed.

DETAILED DESCRIPTION OF PREFERRED EMBODIMENTS

By way of further explanation of the invention, exemplary embodiments of the invention will now be described with reference to the accompanying drawings, in which:

FIG. 1 is a pictorial view of an adapter, comprising an ice-skate blade-chassis with blade attached, which embodies the invention;

FIG. 2*a* is pictorial view of a skate-boot, having in-line rollers attached;

FIG. 2*b* is pictorial view of the skate-boot of FIG. 2*a*, in which the rollers have been removed, and replaced by the adapter of FIG. 1;

Figure 6:
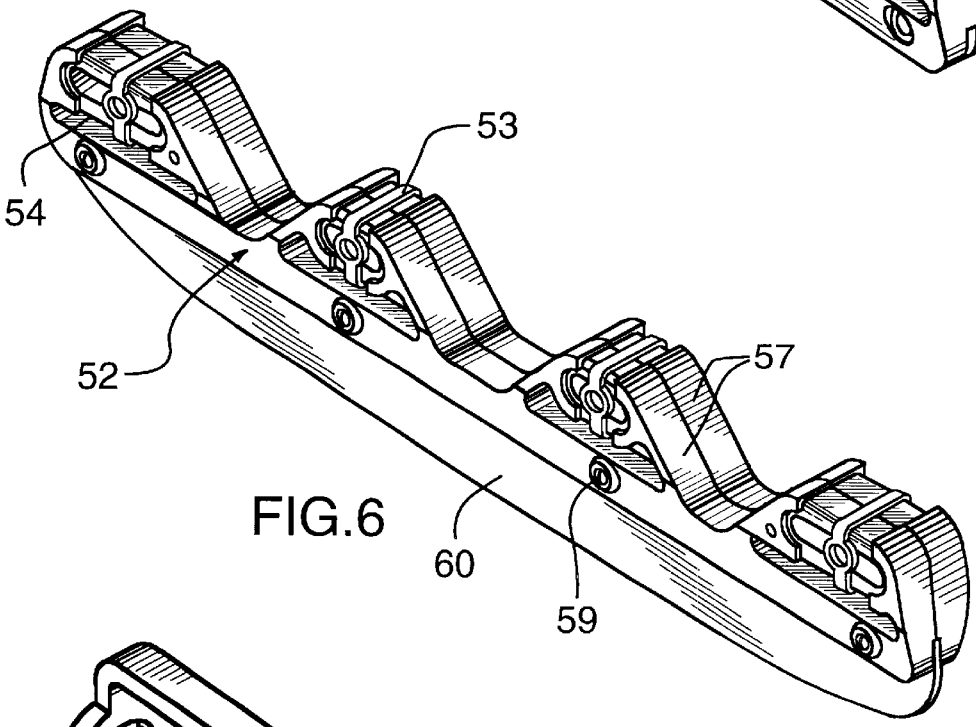
FIG. 6 is a pictorial view of another type of blade-chassis.
Figure 9:
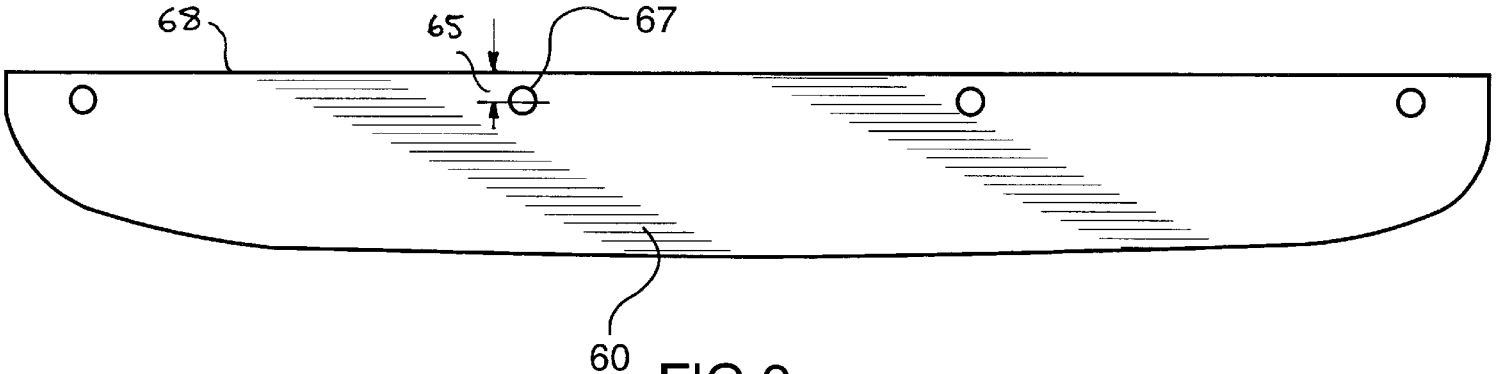
Figure 8B:
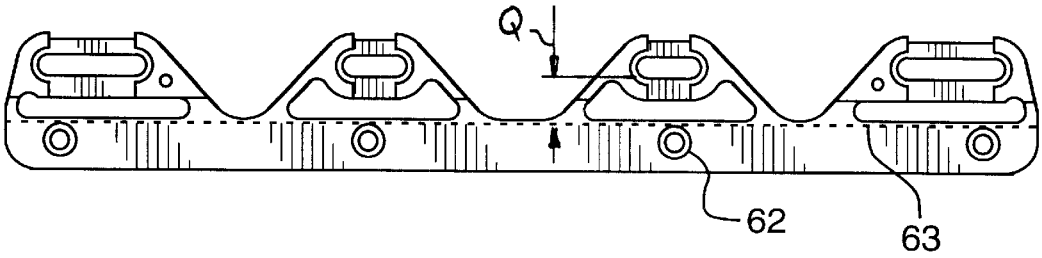
Figure 8C:
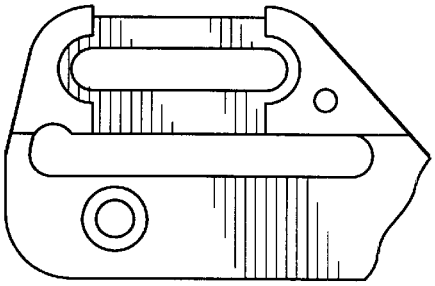
Figure 8D:
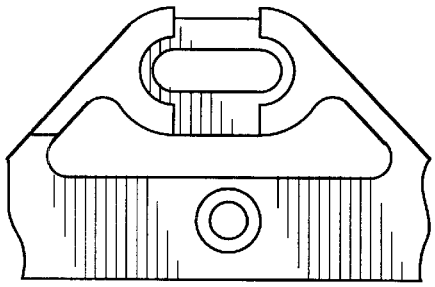
Figure 8E:
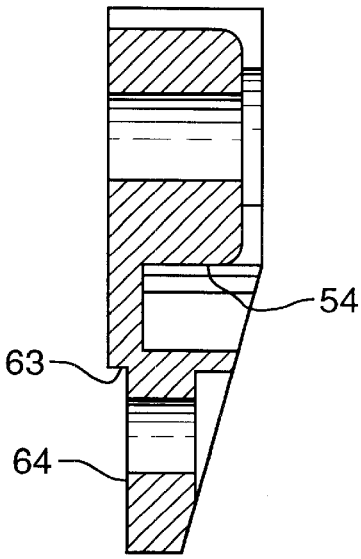
Figure 11A:
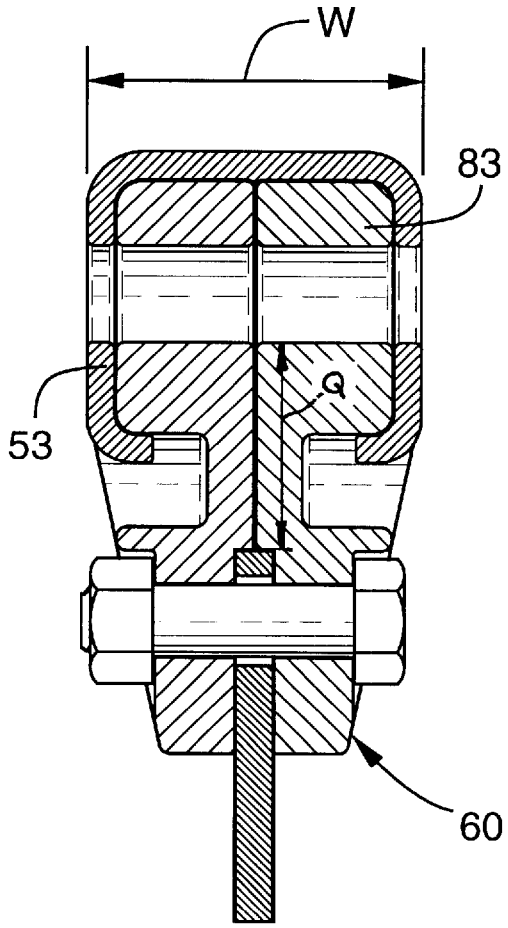
Figure 11B:
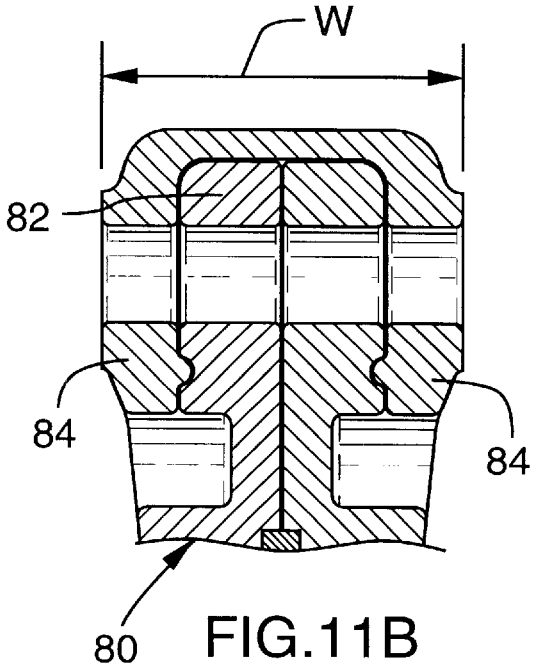
Figure 10:
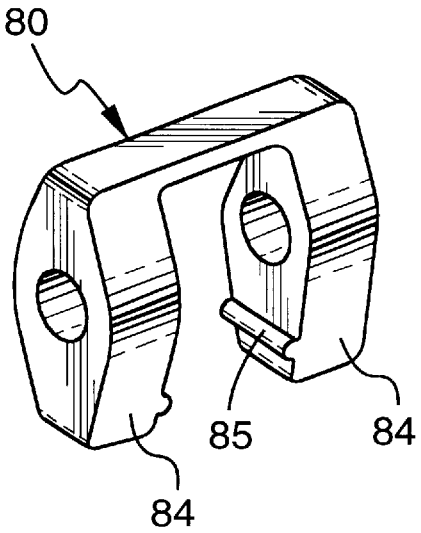
Figure 12:
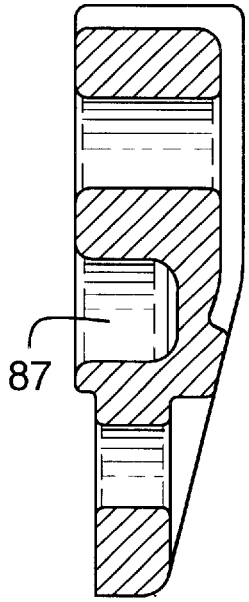

FIGS. 8*a*–8*e* are views of one of the moulded halves of the blade-chassis of FIG. 6;

FIG. 9 is an elevation of an ice-blade;

FIG. 10 is a pictorial view of another captive-washer-component;

FIG. 11*a* is a section of the adapter as shown in FIG. 6;

FIG. 11*b* is a corresponding section of an adapter which incorporates the captive-washer-component of FIG. 10;

FIG. 12 is a section, corresponding to FIG. 8*e*, of another adapter.

The apparatuses shown in the accompanying drawings and described below are examples which embody the invention. It should be noted that the scope of the invention is defined by the accompanying claims, and not necessarily by specific features of exemplary embodiments.

Figure 1:
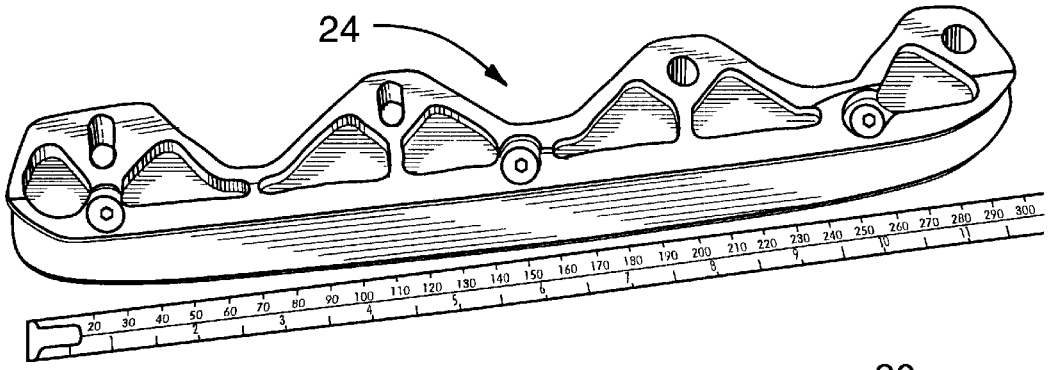
Figure 2A:
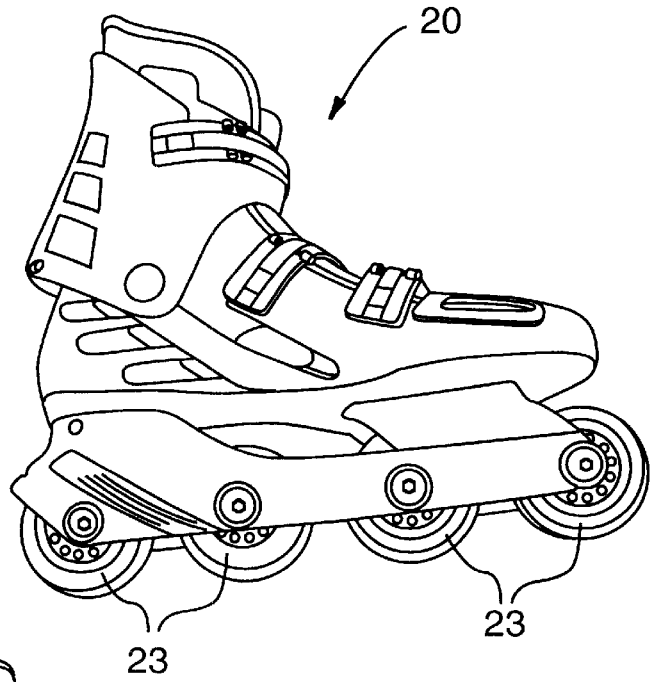
Figure 2B:
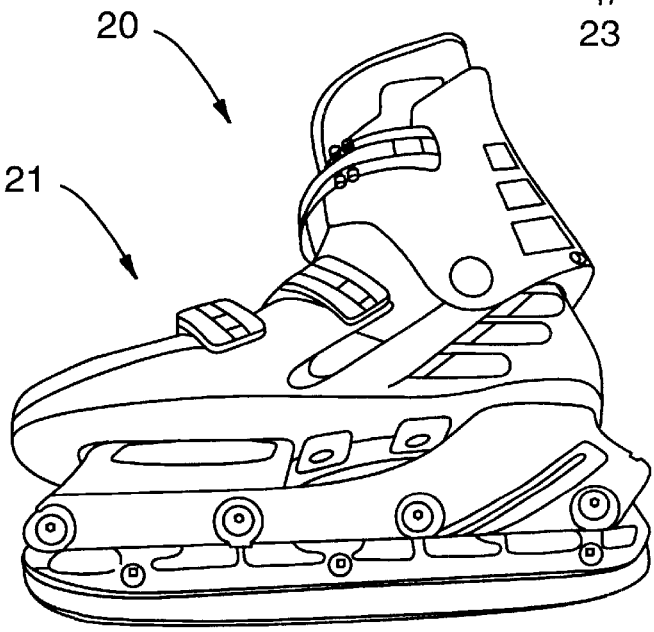

The in-line-roller skate-boot 20 as shown in FIG. 2 has four rollers 23. For converting the skate-boot for ice-skate use, the four rollers 23 are removed, and the ice-skate adapter unit 24, as shown in FIG. 1, is substituted in place of the four rollers, as shown at 21 in FIG. 2.

Figure 3:
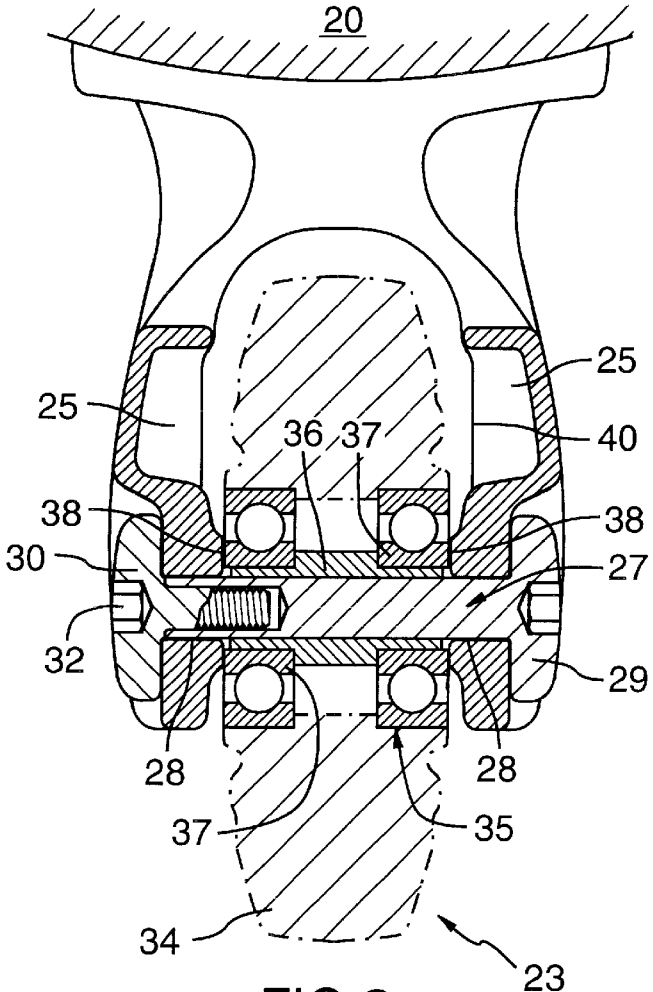
FIG. 3 is a cross-sectioned front elevation of the support-rails structure of an in-line roller skate, showing a roller.

The rollers 23 are mounted in the skate-boot 20 by being supported between left and right support-rails 25. Four spindle-rods 27 pass through through-holes 28 in the support-rails 25. As shown in FIG. 3, the spindle-rods comprise each a bolt 29, having a large head, and a nut 30, also with a large head. Hexagon sockets 32 in the heads of the bolt and nut enable the spindle-rods 27 to be assembled and disassembled with ease. As in-line-roller enthusiasts know, the rollers 23 do have to be replaced from time to time, but replacement is a simple operation. The roller itself comprises a rubber-tired wheel 34, two ball-bearings 35, and a spacer 36. These items remain together as a unit, for ease of assembly and disassembly, the bearings 35 being a press-fit in the (plastic) wheel 34.

The non-rotating inner-races 37 of the ball-bearings 35 are clamped between cheeks 38 on the inwards-facing surfaces 40 of the left and right support-rails 25. The inner-races 37 are clamped axially onto the spacer 36 (of aluminum); the spacer 36 also defines the hole through which the bolt 29 passes.

Figure 4:
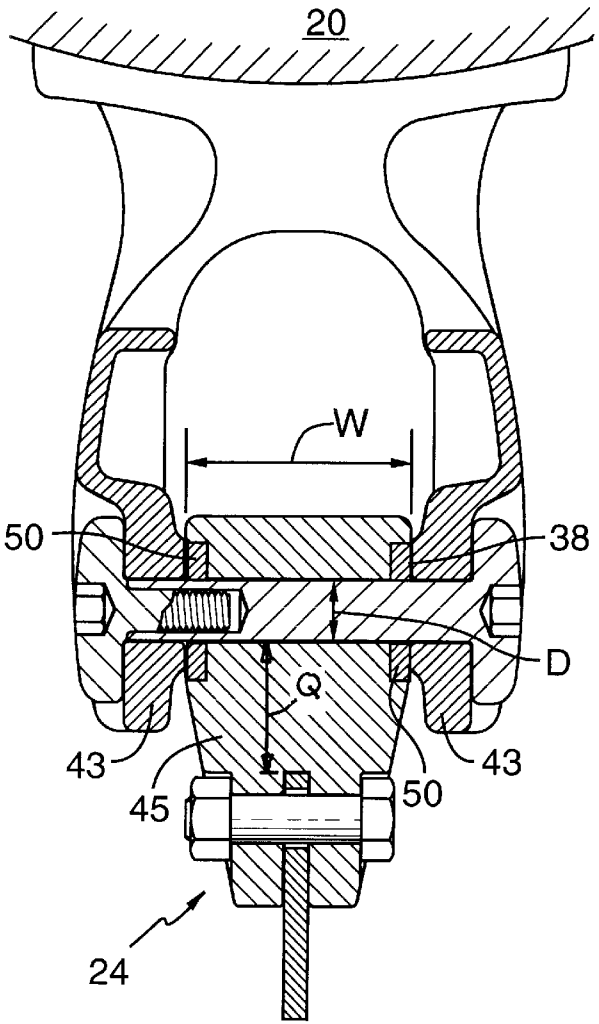
FIG. 4 is the same view as FIG. 3, but shows an ice-skate adapter unit fitted in place of the roller.

As shown in FIGS. 3 and 4, the inwards-facing surface 40 of the support-rail 25 is not flat. Rather, the surface is heavily ribbed. It is only in the marginal zone around the through-hole 28 in the support-rail that the inwards-facing surface 40 becomes a suitable cheek 38 for direct clamping contact against the end-face of the inner-race 37. The cheek 38 is surrounded by a built-up, rigid, strong, chunky boss 43.

The cheek 38 of the inwards-facing surface 40 serves as the place on the inwards-facing surface that actually contacts the inner-race 37. The opposed cheeks 38 on the left and right support-rails 25 define a distance WW inches between them. The distance overall between the end-faces of the inner-races 37 is W inches. The support-rails 25, though tough and strong, are able to deflect inwards, without being damaged, enough to permit the cheeks 38 to be clamped tightly against the end-faces of the inner-race 37. The act of tightening the nut 30 into the bolt 29 is effective to compress the cheeks tightly onto the inner-race.

The width W across the ends of the inner-races is, nominally, 0.90 inches. This is a standard dimension. Many makes and brands of in-line roller skates use rollers having this standard width, and interchangeable replacement wheels are widely available. To be sure, non-standard wheels and skates are sometimes encountered, but it is suggested that the standard, interchangeable, wheels 34 of 0.90 inches width, all conforming to the standard dimensions, account for at least eighty percent of the market. The distance WW as measured between the cheeks 38, i.e the nominal dimension, when the roller 23 is not present, is standardised at 0.92 inches.

The diameter D of the spindle rod 27 is included in the standardisation trend, the standard diameter being ¼ inch.

To change over to ice-skates, the four spindle-rods 27 are unscrewed, and the four rollers 23 are removed from the skate-boot 20. (Skaters are used to this task from replacing rollers.) The ice-skate adapter unit 24 is then secured in place, between the support rails 25, using the four (bolt 29 and nut 30) spindle-rods 27 that were used as the axles of the rollers (FIG. 4).

Even though in-line roller skates have become standardised as to the dimensions of the roller that is used, and as to the number of rollers, (four), the spacing apart of the four rollers is not standardised. The four rollers may be termed the front, the middle-front, the middle rear, and the rear, rollers. The distance from the axis of the front roller to the axis of the rear roller can vary, between different brands, types, and sizes, of in-line roller skate, from nine inches to eleven inches.

The blade-chassis 45 (FIG. 5) of the ice-skate adapter unit 24 is provided with through-holes 46, to accommodate the spindle rods 27, for fixing the blade-chassis 45 between the support-rails 25. When the bolt 29 and nut 30 are tightened together, the cheeks 38 of the support-rails are clamped down onto the outwards-facing surfaces 47 of the blade-chassis 45, just as they were onto the end-faces of the inner-races of the rollers 23.

The through-holes 46 in the blade-chassis 45 are slotted, to the extent necessary to accommodate at least some of the range of spacings of the spindles likely to be encountered with the different makes and size of skate boots.

However, the fact that the holes 46 are slotted means that the area available for the cheeks 38 of the support-rails to clamp down onto, is reduced. The blade-chassis 45 may be a plastic moulding, and the reduced clamp area might lead to the cheeks 38 digging into the side surfaces of the blade-chassis, around the slotted holes 46. This possibility is alleviated by providing recesses 49 in the blade-chassis, and inserting metal washers 50 into the recesses 49. Now, the clamping force is spread over a large enough area that digging-in is no longer likely. When washers 50 are provided, the overall width AA of the blade-chassis is the width over the washers.

Figure 7:
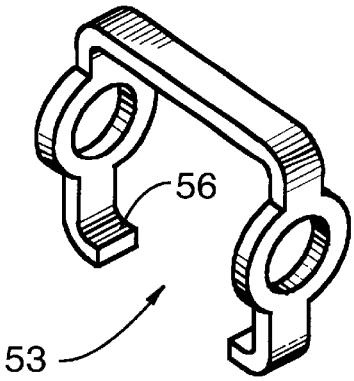
FIG. 7 is a pictorial view of a captive-washer-component of the blade-chassis of FIG. 6.
Figure 8A:
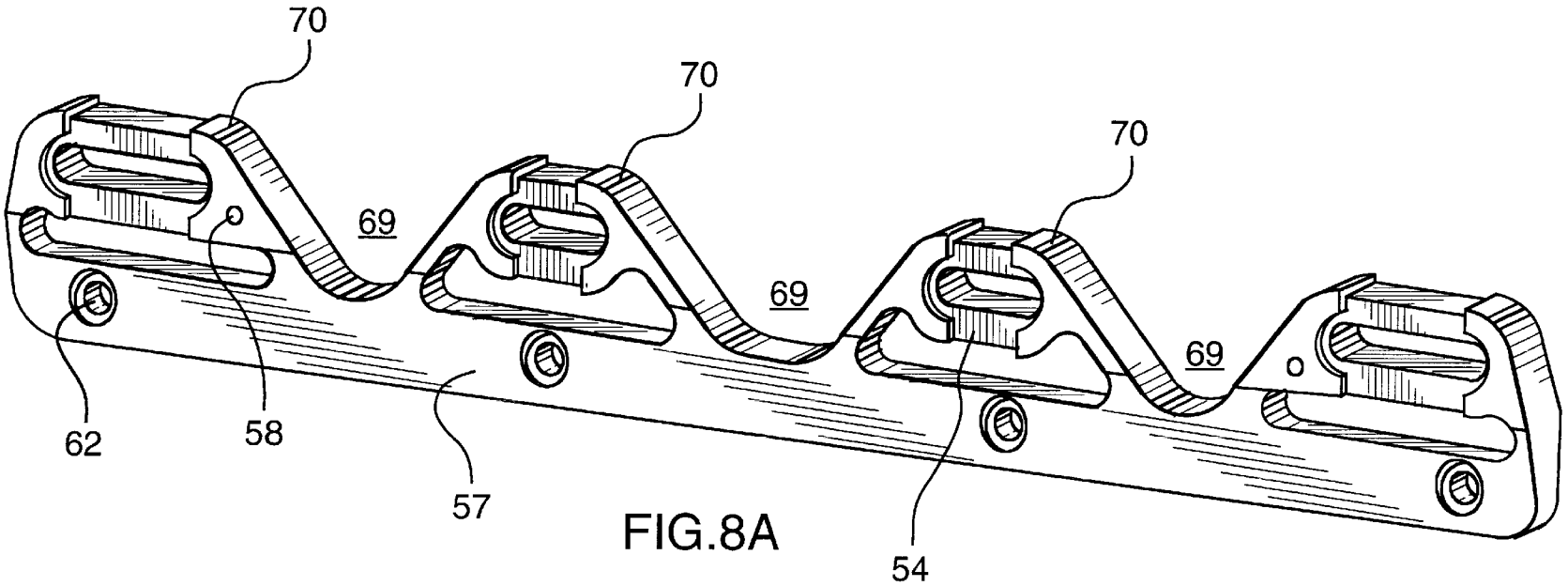

If the designer provides for washers 50, it is very important that they not be omitted, because then the ice-skate would not be securely attached to the skate-boot, and might shift or become loose during vigorous use, possibly causing an injury to the skater. Of course, ordinary washers can be lost, all too easily. FIG. 6 shows a way of arranging for the washers to be captive. Recesses are moulded into the blade-chassis 52, to accommodate the captive-washer-component 53. The captive-washer-component 53 comprises a stamped-out piece of sheet metal, which is bent over, as shown in FIG. 7. The recesses in the blade-chassis 52 especially include a re-entrant surface 54 underneath the through-hole 46, which engages a tag 56 on the captive-washer-component 53, and thereby prevents the captive-washer-component from falling away from the blade-chassis.

The blade-chassis 52 as illustrated in FIG. 6 is split, vertically; i.e the chassis is in two halves 57. When the blade-chassis 45 was moulded in one piece (FIG. 5), the mould for the chassis required cores, withdrawable sliders, etc, whereas the two halves 57 of the FIG. 6 blade-chassis 52 are easy to mould individually, having no need for sliders etc in the mould. The two halves 57 of the mould are held together loosely by the captive-washer-component 53, prior to fitment into the skate-boot 20; when fitted into the skate-boot, the spindle-rods 27 clamp the two halves 57 of the blade-chassis 52 firmly together. Dowels 58 locate the two halves 57 accurately with respect to each other. (The dowels are not loose, but are moulded into the halves.)

The two halves 57 of the blade-chassis 52 are also held together in that screws 59 lock the metal ice-skate blade 60 clamped between the two halves 57. (These screws 59 are not disturbed when assembling or disassembling the ice-skate adapter to or from the skate-boot.)

FIGS. 8*a*–8*e* show the dimensional details of one of the chassis-halves 57.

The positioning of the screws 59 need not follow the positioning of the through-holes 28, and indeed the screws 59 need not be four in number. These screws 59 are not standardised as to position, relative to the skate-boot. The ice-blade 60 itself is shown in FIG. 9. The position of the holes 62 in the chassis-halves 57, for receiving the screws 59, is related to the roof 63 of the half-slot moulded into the chassis-half 57, and to the distance 65 between the holes 67 in the ice-blade 60 and the top edge 68 of the ice-blade 60. The top edge 68 preferably should be seated firmly and tightly against the roof 63 of the (full) slot 64, when the two halves 57 of the blade-chassis 52 are clamped together.

The weight of the skater is supported by the engagement between the top edge 68 of the ice-blade 60 and the roof 63 of the slot 64. This weight can be supplemented sometimes by heavily abusive forces, especially, for example, when the skater is playing hockey. If the blade were so dimensioned that it did not abut the roof of the slot, for example if the blade were only held in place by the screws 59, the chances are that the blade would start to work loose in the chassis, and, again, perhaps cause injury to the skater. Even if the danger to the skater is regarded as minimal, still the blade should not be allowed to work loose, in that the skater would immediately sense or feel the looseness, and such feeling is highly inhibiting as to the type of skating manoeuvres that can be carried out.

It is recognised that the downwards force due to the weight of the skater is very adequately supported by the engineered tight engagement of the top edge 68 of the blade 60 the roof 63 of the slot 64. Even though the blade-chassis 52 comprises plastic mouldings, the plastic chassis is perfectly well able to cope with the heavy forces of contact between the chassis and the metal blade. It is recognised that the other forces on the blade, e.g sideways forces, twisting forces, violent blows and knocks, etc, are of a lesser nature, and again are very adequately handled by the plastic chassis, provided the blade is attached into the chassis with the top edge of the blade tight against the roof of the slot, in the manner indicated.

Thus, the manner of fixing the blade into the chassis, as described, is very robust. Similarly, the manner of attaching the chassis between the support rails 25 is very robust. The support-rails themselves, when clamped onto the blade-chassis 52, is just as robust for ice skating as it was for in-line roller skating. All in all, the conversion of the roller-skate to an ice-skate, when engineered properly in the manner as described herein, provides an ice-skate that is not discernably any less adequately robust as an ice-skate than it was as a roller-skate. So much so, that even violent hockey players will not perceive any inadequacy in the ice-skate conversion.

The designer should avoid passing the spindle-rods through holes in the metal ice-blade itself. If this were done, the resultant very concentrated loads might damage the spindle rods. When the ice-blade lies against the roof of the blade-channel, the loads are well distributed bodily into the whole chassis structure, and not concentrated at a few points.

Figure 5:
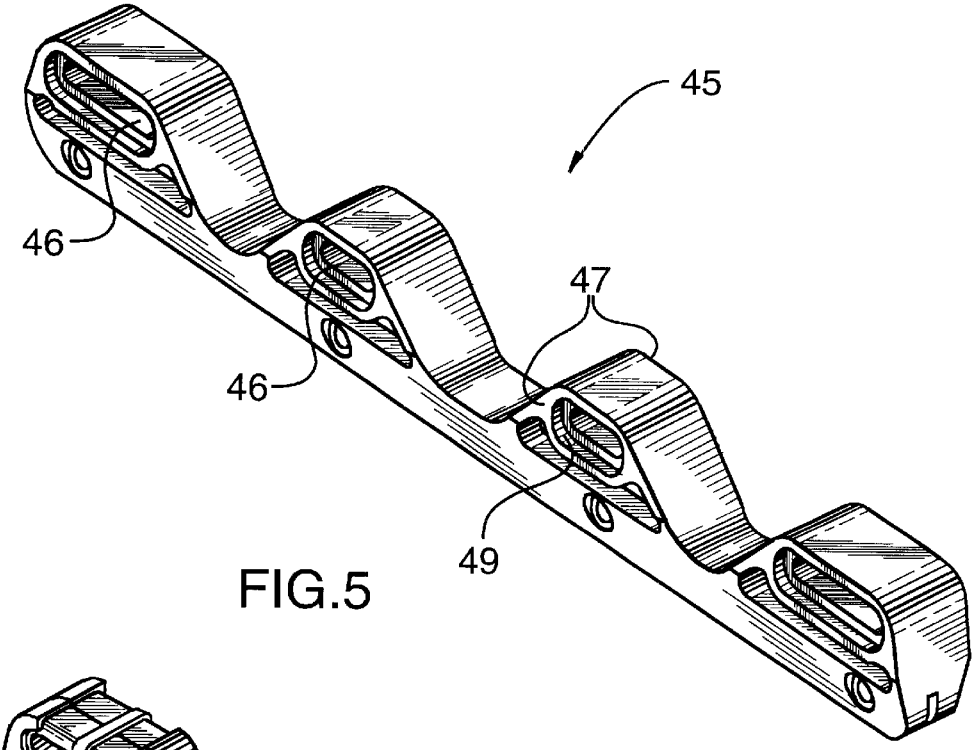
FIG. 5 is a pictorial view of a blade-chassis.

In FIGS. 5 and 6, it will be noted that the chassis is cut away, at 69, whereby the through-holes 46 are formed in promontories 70 of the blade-chassis 52. Some in-line roller skate-boots have bridges, which connect between the support-rails (between the rollers) for added rigidity, and the areas 69 are provided to accommodate these bridges.

Some skaters wish to have a means to adjust the position of the ice-blade relative to the foot. Thus, a defenceman in hockey, who needs good "bite" of the skate into the ice when skating backwards, might wish to position the blade a little farther forward, relative to the foot, than a forward, who prefers the best "bite" when skating forwards. The adapter as described herein allows plenty of scope for this kind of adjustment, unless the slotted through-holes 46 are being used at one or other of their extremes. Some adjustment may be proved also by slotting the holes 67 in the ice blade.

Some skaters also wish to provide a different kind of adjustment, in which the skate is set (slightly) higher at the back than at the front. The ice-skate adapter system as described herein can be used to provide this adjustment. That is to say, an adapter can be provided in which the height of the blade at the left end (see FIG. 8) is a little more than the height of the blade at the right end. Special blades are manufactured in this case. Once such a special ice-blade is secured into the chassis, care should be taken to assembly the adapter into the skate-boot the right way round. It may be noted that when the symmetrical ice-blade 60 as shown in FIG. 8 is used, the ice-skate adapters 24 can be assembled either way round, and in either the left or right skate-boots. The two half-mouldings 57 that make up the chassis 52 are identical, i.e they are not left/right handed.

When the blade-chassis is moulded in one piece, difficult as that is to mould, at least then the ice-blade can be moulded directly into the plastic moulding, which is very secure, and can save on screws. However, the two-halves system is preferred, since it simplifies moulding, and enables the ice-blade to be replaced, if desired.

In fact, different styles of blades can be provided, for fitment into the chassis. For example, the chassis can accommodate not only hockey blades, but figure-skating blades, which have a slightly flatter curvature, and have serrations at one end; and can accommodate also speed-skating blades, in which the ice-blade itself is long, and substantially not curved. One of the aspects of modern speed-skates is that the blade itself should be able to pivot relative to the boot, about a horizontal transverse axis, and a suitable pivot structure can be built into the blade-chassis, if required. Again, one of the major benefits of the invention is that a single pair of boots will serve for the different skating related activities; it is recognised that the transfer from in-line-rollers to hockey-style skates makes the most of the way in-line boots have come to be designed, but it is recognised that boots developed for in-line roller skating are nearly almost as suitable for figure-skating and speed-skating as they are for hockey.

The exemplary adapter as described above is standardised to a size that makes the adapter suitable for fitment into the large majority of in-line roller-skates currently on the market. There are, however, some roller-skates which are made to somewhat different dimensions. In that case, if the configuration is basically the same, but the dimensions are slightly changed, then, within limits, a similar design of adapter can be specially tailored, dimensionally, to meet the other standard. The limitations are that the skate-boot must have two parallel rails, the rollers being mounted in the space between the rails. The axles or spindles of the rollers must be mounted in holes in the rails. As to the width of the space between the rails, the width of the chassis must be wide enough to provide the required degree of lateral and torsional support for the ice-blade. Preferably, the rails should be a minimum of 0.7 inches apart, from this standpoint.

Some types of in-line roller skate have three rollers. Some have five. Of course, in those cases, the adapter that fits the standard four-roller skate will not be suitable. If desired, a special adapter may be provided that will fit only a small segment of the market.

In some non-standard roller-skates boots, the diameter of the roller spindle might not be ¼ inch. However, inevitably, the spindle has to be strong enough to support the roller, and it may be noted that any spindle that is strong enough to support a roller will surely serve as one of the bolts clamping the ice-blade chassis between the rails.

While a roller spindle bolt, even if not ¼ inch diameter, is adequate to clamp the chassis tightly between the rails, the designer should take care that the spindle bolt cannot become overstressed. Thus, the spindle bolt should not pass through a hole in the skate-blade; or at least, not in such a manner that forces being transmitted between the ice-blade and the boot would pass by direct touching contact between the ice-blade and the spindle. It is recognised that such direct contact entails a point-loading, which might very easily overstress the spindle bolt. The ice-blade should preferably be supported in the chassis in a blade-receiving channel, e.g of the type as shown at xx in the previous drawings. The designer should see to it that the ice-blade is not supported in the chassis by direct contact with the roller spindle bolts, or by other bolts that pass through the roller-spindle holes in the rails.

FIG. 10 shows an alternative, in which the captive-washer-component 80 is moulded in nylon, or a tough composite plastic. This may be contrasted with the captive-washer-component 53 shown in FIG. 7, which comprised a stamped-out, bent-over, piece of sheet metal. FIGS. 11*a* , 11*b* contrast the thickness of the chassis body, the body portion 82 of the component 80 being thinner than the corresponding body portion 83 of the component 60 of FIG. 7. The designer makes the chassis body slightly narrower, at 83, where the body is clamped between the washer-portions 84 of the component 80, to allow for the washer-portions 84 (being plastic) being a little thicker than the thickness of the sheet metal of the component 53. The thickness of the chassis is important from the standpoint of rigidity and robustness, and the width of the portion 82 should not be less than about 0.5 inches.

The (moulded plastic) component 80 may include ledges 85, which engage complementary grooves in the (moulded plastic) body portion 82, to prevent the component 80 from falling away, and to improve the fit of the parts and the resulting strength of the assembly. Of course, the thickness overall W of the portion of the body of the chassis plus the two washer-portions 84 of the component 80, must be tailored to the width WW apart of the rails.

In FIG. 6, the two half-mouldings 57 that make up the chassis 52 are identical, i.e they are not left/right handed. This is not essential, and a manufacturer might choose to configure the chassis to give the appearance of speed, etc, which would probably require the two halves to be mirror images of, rather than identical to, each other.

In FIG. 6, the chassis is shown ribbed on the outside, whereby the ribs are visible when the adapter is in use. Again, if concerned with creating an appearance of speed etc, the manufacturer might prefer to have the ribs on the inside. This can be done, for example in the configuration as shown in FIG. 12, which shows an inside ribbed area 87, and which may be contrasted with FIG. 8*e*.

What is claimed is:

1. Apparatus for converting an in-line-roller skate-boot for use as an ice-skate-boot, wherein the apparatus is so structured as to be suitable for use with a skate-boot having the following characteristics:

- the skate-boot has left and right support-rails, integrated into the structure of the skate-boot;
- the left and right support-rails extend from front to rear of the skate-boot, and have opposed left and right inwards-facing surfaces, disposed in a spaced-apart parallel relationship;
- the support-rails are so structured as to carry a number N of rollers, in-line;
- in respect of each of the N rollers:
  - the roller is provided with a spindle-rod of diameter D inches;
  - the spindle-rod straddles between the left and right support-rails, and passes through spindle-through-holes in the support-rails;
  - the roller has a bearing, which includes a non-rotating inner-race-structure;
  - the non-rotating inner-race-structure fits over the spindle-rod, and has left and right end-faces, which are spaced an axial width W inches apart, overall;
- the left and right support-rails each have N spindle-through-holes, which carry the spindles that support the N rollers;
- in respect of each of the N spindle-through-holes in the support-rails:
  - the inwards-facing surface of the left support-rail includes a marginal annular left-cheek, and the inwards-facing surface of the right support-rail includes a marginal annular right-cheek;
  - the left and right support-rails are so configured that the left-cheek and the right-cheek are spaced a distance WW inches apart;
  - the distance WW between the cheeks is so related to the width W of the non-rotating inner-race-structure, that the left and right cheeks can be drawn together, and can be clamped thereby into tight contact with the left and right end-faces of the non-rotating inner-race-structure;

the spindle-rod includes clamping-means, for clamping the cheeks of the left and right rails tightly against the end faces of the non-rotating inner-race-structure;

the front-rear distance between a frontmost one of the spindle-through-holes and a rearmost one of the spindle-through-holes is between FRmax and FRmin inches;

the apparatus includes an ice-skate adapter unit, comprising a blade-chassis and a skate-blade, which has the following characteristics;

the blade-chassis has N chassis-through-holes, corresponding to the N spindle-through-holes of the support-rails;

the N chassis-through-holes are so dimensioned that the N spindle-rods can pass respectively therethrough;

in respect of each of the chassis-through-holes, the blade-chassis has left and right, outwards-facing, parallel side-walls, which are annularly marginal to the chassis-through-holes;

the distance apart of the outwards-facing side-walls of the blade-chassis is equal to W inches;

the blade chassis has a downwards-opening blade-channel, with side-faces and a roof;

an ice-blade has an upper edge, which is engaged against the roof of the blade-channel;

the adapter unit includes a means for attaching the ice-blade into the blade-chassis, and for preventing the ice-blade from moving longitudinally along the blade-channel, and for preventing the ice-blade from falling out of the blade-channel;

the blade chassis is of such robust structure as to provide support of the ice-blade relative to the skate-boot, during skating;

the blade-chassis is of plastic material;

with respect to each of the N spindle-through-holes:

the roof of the blade-channel lies underneath and below the chassis-through-hole;

a dimension of the blade-chassis relates to the said roof of the blade-channel and to the chassis-through-hole, and is the distance Q, being the length of the shortest line that can be drawn, wholly through the material of the chassis, from the roof to the chassis-through-hole;

a support-zone of the material of the blade-chassis lies around, and includes, the distance Q;

the structure of the chassis is such that, in use, the force of the weight of the skater passes from the roof of the blade-channel to the chassis-through-hole, and to the spindle-rod therein, through the said support-zone;

the distance Q is a large enough distance that the said support-zone of the material of the chassis, between the roof and the chassis-through-hole, is characterised as thick and stocky;

the support-zone is thick and stocky to the extent that the weight of the skater becomes well-distributed along the length of the spindle-rod, the support-zone is thick and stocky to the extent that the weight of the skater is spread over a large enough volume of the plastic material of the chassis that the stresses induced in the plastic material by the weight of the skater are well below the level the plastic material can support without damage.

2. Apparatus of claim 1, wherein the distance Q is about 0.55 inches.

3. Apparatus of claim 1, wherein the diameter D of the spindle-rod is ¼ inch.

4. Apparatus of claim 1, wherein the width W of the rollers is 0.9 inches.

5. Apparatus of claim 1, wherein the number N of rollers is four.

6. Apparatus of claim 1, wherein the diameter D of the spindle-rod is ¼ inch, the width W of the rollers is 0.9 inches, and the number N of rollers is four.

7. Apparatus of claim 1, wherein the chassis-through-holes are slotted, the slots being of such dimensions as to enable the same adapter unit to be fitted to a skate-boot having an FRmax of 11 inches and to a skate-boot having an FRmin of 9 inches, in which the number of rollers is four.

8. Apparatus of claim 1, wherein:

the blade chassis includes a body, and includes annular washers that are positioned on the spindle-rods, between the body and the cheeks of the support-rails;

the outwards facing side walls of the chassis comprise outwards-facing surfaces of the washers;

and the width W obtains over the outwards-facing surfaces of the washers.

9. Apparatus of claim 8, wherein the washers are integral with a captive-washer-component, which is so structured that the washers are held captive on the body.

10. Apparatus of claim 9, wherein the captive-washer-component is of sheet metal, and includes a bridge-portion which lies straddled over the top of the chassis.

11. Apparatus of claim 9, wherein the captive-washer-component is a plastic moulding.

12. Apparatus of claim 8, wherein the thickness of the body, between the washers, is at least 0.6 inches.

13. Apparatus of claim 1, wherein the chassis is moulded in two chassis-halves, which are split symmetrically along a vertical longitudinal plane.

14. Apparatus of claim 13, wherein:

the two chassis-halves have respective upper-flat-faces;

the chassis-halves are so structured that, in use, the upper-flat-faces are in face-to-face abutment, and are held tightly pressed together by the clamping-means on the spindle-rods;

the chassis-halves are formed with respective lower-flat-faces, and the lower-flat-faces are parallel to, and spaced from, the upper-flat-faces, in a stepped configuration;

the chassis-halves are formed with respective ledges, between the upper flat-faces and the lower-flat-faces;

the lower-flat-faces form the side-walls of, and the ledges together form the roof of, the blade-channel.

15. Apparatus of claim 14, wherein:

the adapter unit includes blade-clamping-bolts, which pass through the two chassis-halves, and through the ice-blade, and which are effective to retain the blade tightly clamped in the blade-slot;

the blade-clamping-bolts are so located in the ice-skate adapter unit that, when the unit is assembled into the skate-boot, the blade-clamping-bolts lie positioned well clear of, and below, the support-rails of the skate-boot.

16. Apparatus of claim 1, wherein the blade-chassis has N upwardly-directed promontories, and the N chassis-through-holes are positioned in the promontories, and the promontories are so positioned as to provide room, therebetween, for stiffening bridges spanning across between the support-rails.

17. Apparatus of claim 1, wherein the means for attaching the ice-blade into the blade-channel comprises threaded fasteners, and the arrangement of the apparatus is such that the said fasteners can be pre-tightened, and can remain undisturbed, when the adapter unit is being assembled and secured between the support-rails.

18. Apparatus of claim 17, wherein the threaded-fasteners pass through respective holes in the ice-blade, which are of large enough clearance on the fasteners as not to inhibit fitment of the upper-edge of the ice-blade hard against the roof of the blade-slot.

19. The combination of the apparatus of claim 1, with the skate boot.

* * * * *